US005527987A

United States Patent [19]

Yamamoto et al.

[11] Patent Number: 5,527,987

[45] Date of Patent: Jun. 18, 1996

[54] KEYBOARD MUSICAL INSTRUMENT WITH SOLENOID-OPERATED ACTUATORS ARRANGED IN INTERDIGITATED MANNER

[75] Inventors: Jun Yamamoto; Tsutomu Sasaki, both of Shizuoka, Japan

[73] Assignee: Yamaha Corporation, Japan

[21] Appl. No.: 250,167

[22] Filed: May 27, 1994

[30] Foreign Application Priority Data

Jun. 3, 1993 [JP] Japan ..... 5-035135 U

[51] Int. Cl.[6] ..... G10F 1/02

[52] U.S. Cl. ..... 84/18; 84/20

[58] Field of Search ..... 84/18, 19, 20, 84/21

[56] References Cited

U.S. PATENT DOCUMENTS 4,741,237 5/1988 Murakami et al. ..... 84/20

*Primary Examiner*—Patrick J. Stanzione

*Attorney, Agent, or Firm*—Graham & James

[57] ABSTRACT

A plurality of solenoid-operated actuator units are incorporated in an automatic player piano for selectively driving keys in a playback mode, and share two elongated yoke members interdigitated with one another so as to house the solenoid-operated actuator units as close as possible without sacrifice of electro-magnetic forces produced thereby.

7 Claims, 10 Drawing Sheets

KEYBOARD MUSICAL INSTRUMENT WITH SOLENOID-OPERATED ACTUATORS ARRANGED IN INTERDIGITATED MANNER

FIELD OF THE INVENTION

This invention relates to a keyboard musical instrument and, more particularly, to an automatic player piano having solenoid-operated actuator units arranged in an interdigitated manner.

DESCRIPTION OF THE RELATED ART

A typical example of the automatic player piano is illustrated in FIG. 1 of the drawings, and largely comprises a grand piano 1 and a key driving system 2. The automatic player piano selectively enters into a playing mode and a playback mode.

The grand piano 1 is familiar to a person skilled in the art, and has a keyboard 1*a* implemented by a plurality of black and white keys 1*b* and 1*c*, a plurality of key action mechanisms 1*d* respectively linked with the black and white keys 1*b* and 1*c*, a plurality of hammer assemblies 1*e* respectively driven by the key action mechanisms 1*d* for rotation and a plurality sets of strings 1*f* struck by the hammer assemblies 1*e*, respectively. The keyboard 1*a* is supported by a key frame 1*g*, and the key frame 1*g* is mounted on a key bed structure 1*h*, and the black and white keys 1*b* and 1*c* are swingable with respect to the key frame 1*g* and, accordingly, to the key bed structure 1*h*.

When a player depresses the black or white key 1*b* or 1*c* in the playing mode, the depressed key causes the associated key action mechanism 1*d* to rotate in the clockwise direction, and the key action mechanism 1*d* kicks the associated hammer assembly 1*e* so as to rotate in the counter clockwise direction. The hammer assembly thus driven for rotation strikes the associated set of strings 1*f*, and rebounds thereon. The set of strings 1*f* vibrate for producing an acoustic sound.

The key driving system comprises a controller (not shown) and an array of solenoid-operated actuator units 2*a* and 2*b* respectively associated with the black and white keys 1*b* and 1*c*, and the controller selectively energizes the solenoid-operated actuator units 2*a* and 2*b* in the playback mode. The solenoid-operated actuator units 2*a* and 2*b* upwardly project head members 2*c* and 2*d* attached to the plungers 2*c* and 2*d*, and cause the associated black and white keys 1*b* and 1*c* to rotate as if the player depresses.

The solenoid-operated actuator units 2*a* and 2*b* are arranged in two rows, and the two rows of solenoid-operated actuator units 2*a* and 2*b* are associated with odd keys and even keys, respectively. The solenoid-operated actuator units 2*a* and 2*b* are similar in structure to one another, and one of the solenoid-operated actuator units 2*a* and 2*b* is illustrated in detail in FIG. 2. The solenoid-operated actuator unit 2*a* or 2*b* comprises a yoke member 2*e* shared between the other solenoid-operated actuator units of the same row, a coil bobbin 2*f* housed in the yoke member 2*e*, a coil member 2*g* wound on the coil bobbin 2*f* and a plunger member 2*h* slidably inserted in an inner space of the coil bobbin 2*f* and partially projecting from a hole 2*i* formed in the yoke member 2*e*, and the head member 2*c* or 2*d* is fixed to the leading end portion of the plunger member 2*h*.

As will be better seen from FIGS. 3 and 4, the yoke member 2*e* is an elongated channel shape, and the holes 2*i* are formed in the upper surface portion of the yoke member 2*e* at intervals. The corners of the yoke members are rounded, and have the radius of curvature r. When a plate member is shaped into the elongated channel through a pressing work, the round corners are inevitably produced, and the pressing work is desirable in view of low production cost. For this reason, when the coil member 2*g* wound on the bobbin 2*f* is assembled with the yoke member 2*e*, gaps r take place between the coil member 2*g* and the inner surface of the yoke member 2*e* as shown in FIG. 2.

As described hereinbefore, the solenoid-operated actuator units 2*a* and 2*b* are arranged in two rows, and the yoke member 2*e* for one of the two rows is attached to the yoke member 2*e* for the other of the two rows as shown in FIG. 5. Even if the yoke members 2*e* are attached to each other without a gap, the two rows of solenoid-operated actuator units 2*a* and 2*b* occupies a space wider than the total space of the two rows of coil members 2*g* and the side wall portions of the yoke members 2*e* due to the rounded corners.

It is desirable for the solenoid-operated actuator units 2*a* and 2*b* to increase the number of turns of the coil member per unit length, because the coil member 2*g* produces a large amount of electro-magnetic force. However, the gaps r do not allow a manufacturer to increase the turns of the coil member 2*g* per unit length. Although a prolonged coil bobbin 2*f* increases the number of turns, the enlarged solenoid-operated actuator units are hardly housed in the narrow space between the keys 1*b* and 1*c* and the key bed structure 1*h*. Therefore, the first problem inherent in the prior art is the trade-off between insufficient electro-magnetic force and the actuator size.

The second problem is the two kinds of solenoid-operated actuator units different in height H. As described hereinbefore, the gaps r space the row of solenoid-operated actuator units 2*c* associated with the odd keys from the row of solenoid-operated actuator units 2*d* associated with the even keys. The keys 1*b* and 1*c* decline in the rest position with respect to the key frame 1*g*, and the gap between each key and the key frame 1*g* is decreased along the longitudinal direction of the key. This means that the difference in gap between the rows of solenoid-operated actuator units 2*a* and 2*b* is not ignoreable, and the manufacturer is required to prepare two kinds of solenoid-operated actuator units 2*a* and 2*b* different in height.

SUMMARY OF THE INVENTION

It is therefore an important object of the present invention to provide an automatic player piano which has an array of solenoid-operated actuator units arranged as close as possible.

To accomplish the object, the present invention proposes to interdigitate yoke members with one another.

In accordance with one aspect of the present invention, there is provided a keyboard musical instrument selectively entering into at least a playing mode for producing acoustic sounds through a fingering and a playback mode for producing acoustic sounds without the fingering, comprising: a) an acoustic piano having a-1) a keyboard having a plurality of keys swingable with respect to a stationary board member forming a part of the acoustic piano, and allowing a player to perform a music through the fingering in the playing mode, a-2) a plurality sets of strings associated with the plurality of keys for producing the acoustic sounds, respectively, a-3) a plurality of hammer assemblies respectively associated with the plurality sets of strings and rotatable toward the associated sets of strings, and a-4) a plurality of key action mechanisms respectively associated with the plurality of keys and linked between the associated keys and the associated hammer assemblies for driving the associated hammer assemblies toward the associated sets of strings when the associated keys are depressed; and b) a key driving system enabled in the playback mode, and having b-1) a plurality sets of coil members and plungers respectively associated with the plurality of keys and selectively actuating the associated keys as if the player depresses through the fingering, and b-2) a plurality of yoke members supporting the plurality sets of coil members and plungers and interdigitated with one another.

In accordance with another aspect of the present invention, there is provided a keyboard musical instrument selectively entering into at least a playing mode for producing acoustic sounds through a fingering and a playback mode for producing acoustic sounds without the fingering, comprising: a) an acoustic piano having a-1) a keyboard having a plurality of keys swingable with respect to a stationary board member forming a part of the acoustic piano, and allowing a player to perform a music through the fingering in the playing mode, a-2) a plurality sets of strings associated with the plurality of keys for producing the acoustic sounds, respectively, a-3) a plurality of hammer assemblies respectively associated with the plurality sets of strings and rotatable toward the associated sets of strings, and a-4) a plurality of key action mechanisms respectively associated with the plurality of keys and linked between the associated keys and the associated hammer assemblies for driving the associated hammer assemblies toward the associated sets of strings when the associated keys are depressed; and b) a key driving system enabled in the playback mode, and having b-1) a plurality sets of coil members and plungers respectively associated with the plurality of keys and selectively actuating the associated keys as if the player depresses through the fingering, and b-2) a plurality of yoke members supporting the plurality sets of coil members, each of the plurality of yoke members having rounded corner portions between side wall portions thereof and an upper wall portion thereof, a plurality of first hollow spaces being formed in one of the rounded corner portions at intervals for partially exposing the associated set of coil members and plungers, thereby arranging outer surfaces of the associated coil members to be as close to an inner surface of the aforesaid each of the plurality of yoke members as possible.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENT

Figure 1:
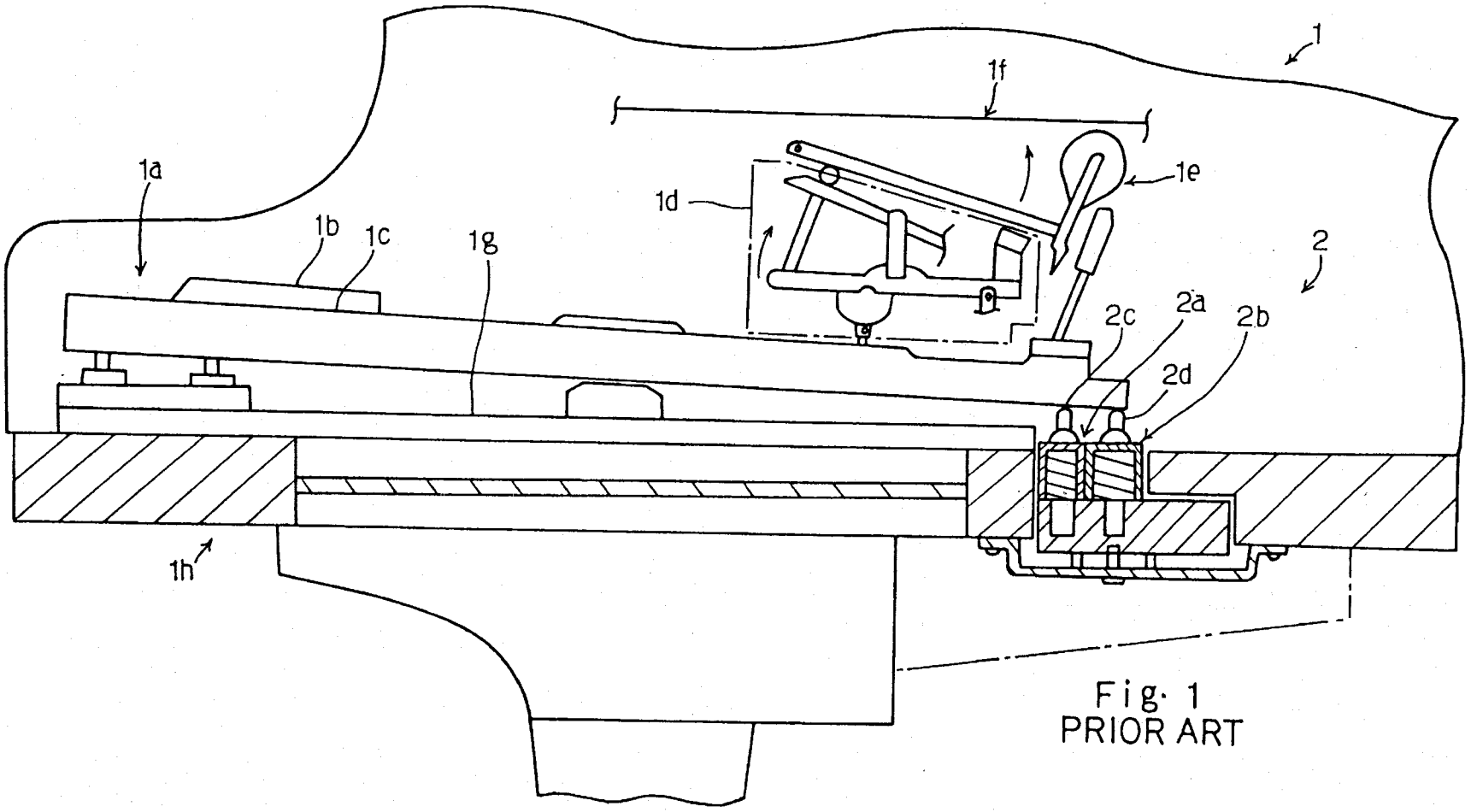
Fig. 1 PRIOR ART
FIG. 1 is a cross sectional view showing the prior art automatic player piano.
Figure 2:
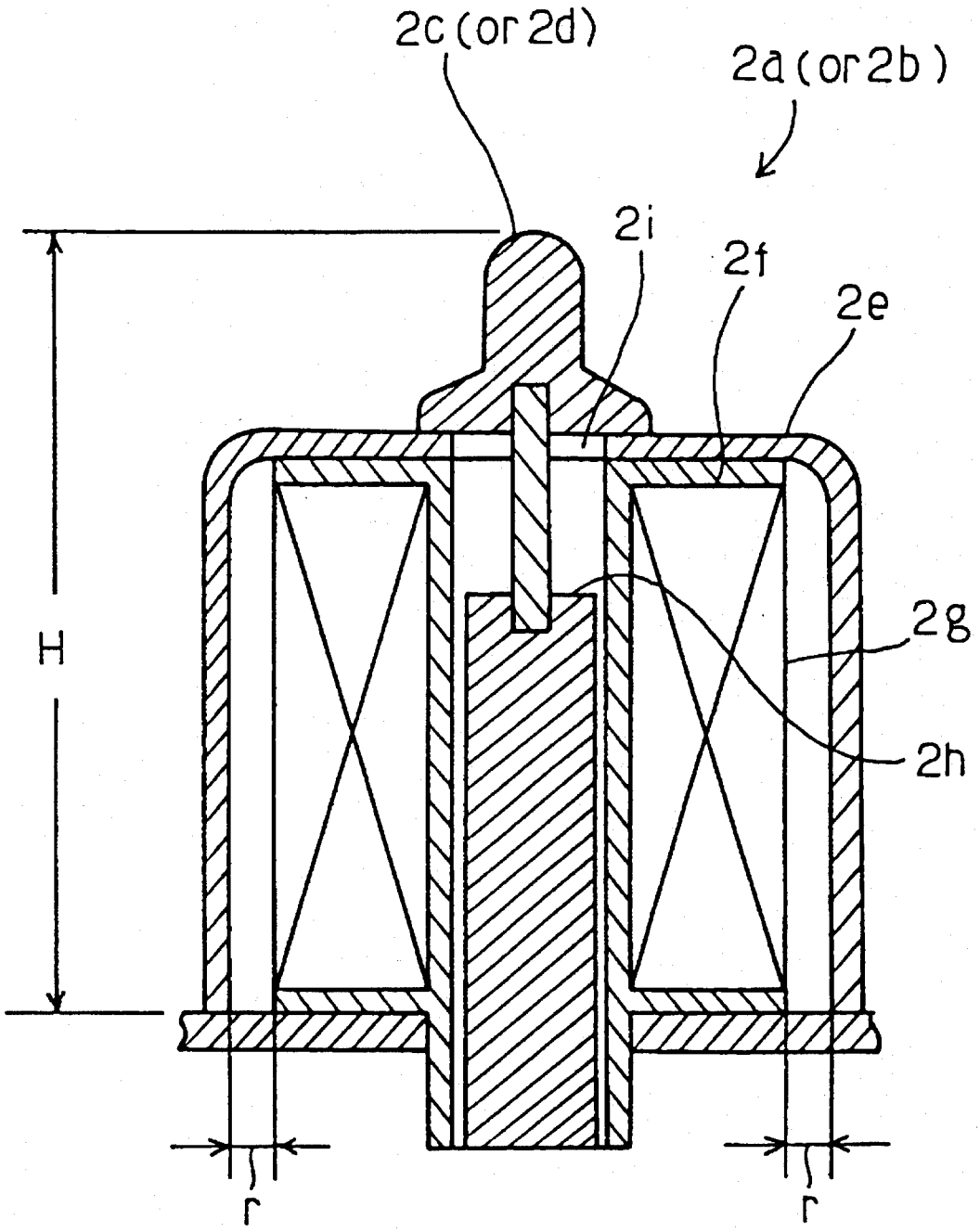
Fig. 2 PRIOR ART
FIG. 2 is a cross sectional view showing the structure of the solenoid-operated actuator unit incorporated in the prior art automatic player piano.
Figure 3:
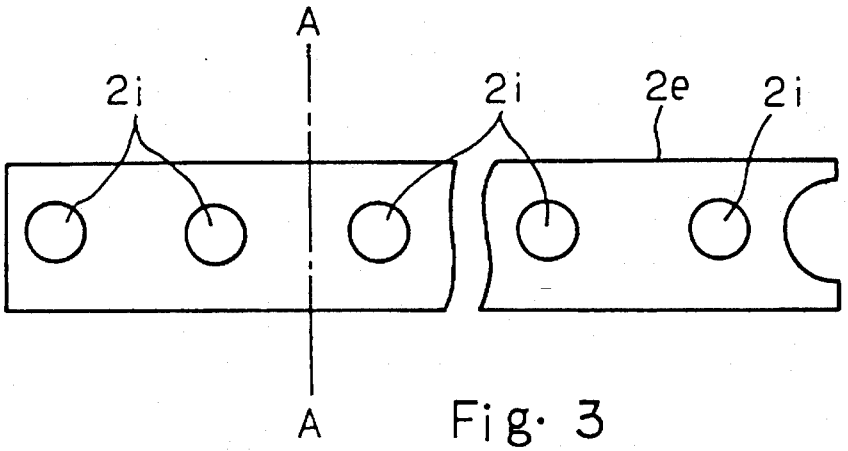
Fig. 3 PRIOR ART
FIG. 3 is a plan view showing the upper surface of the yoke forming the part of the prior art solenoid-operated actuator unit.
Figure 4:
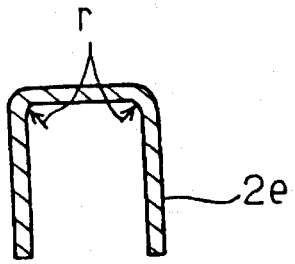
Fig. 4 PRIOR ART
FIG. 4 is a cross sectional view taken along line A—A of FIG. 3.
Figure 5:
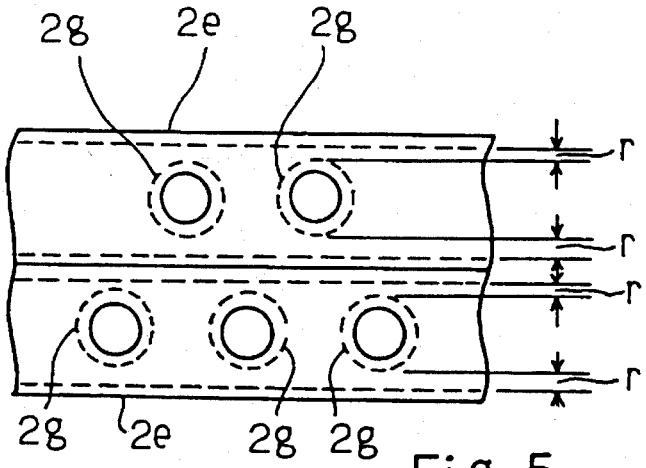
Fig. 5 PRIOR ART
FIG. 5 is a plan view showing the array of the prior art solenoid-operated actuator units.
Figure 6:
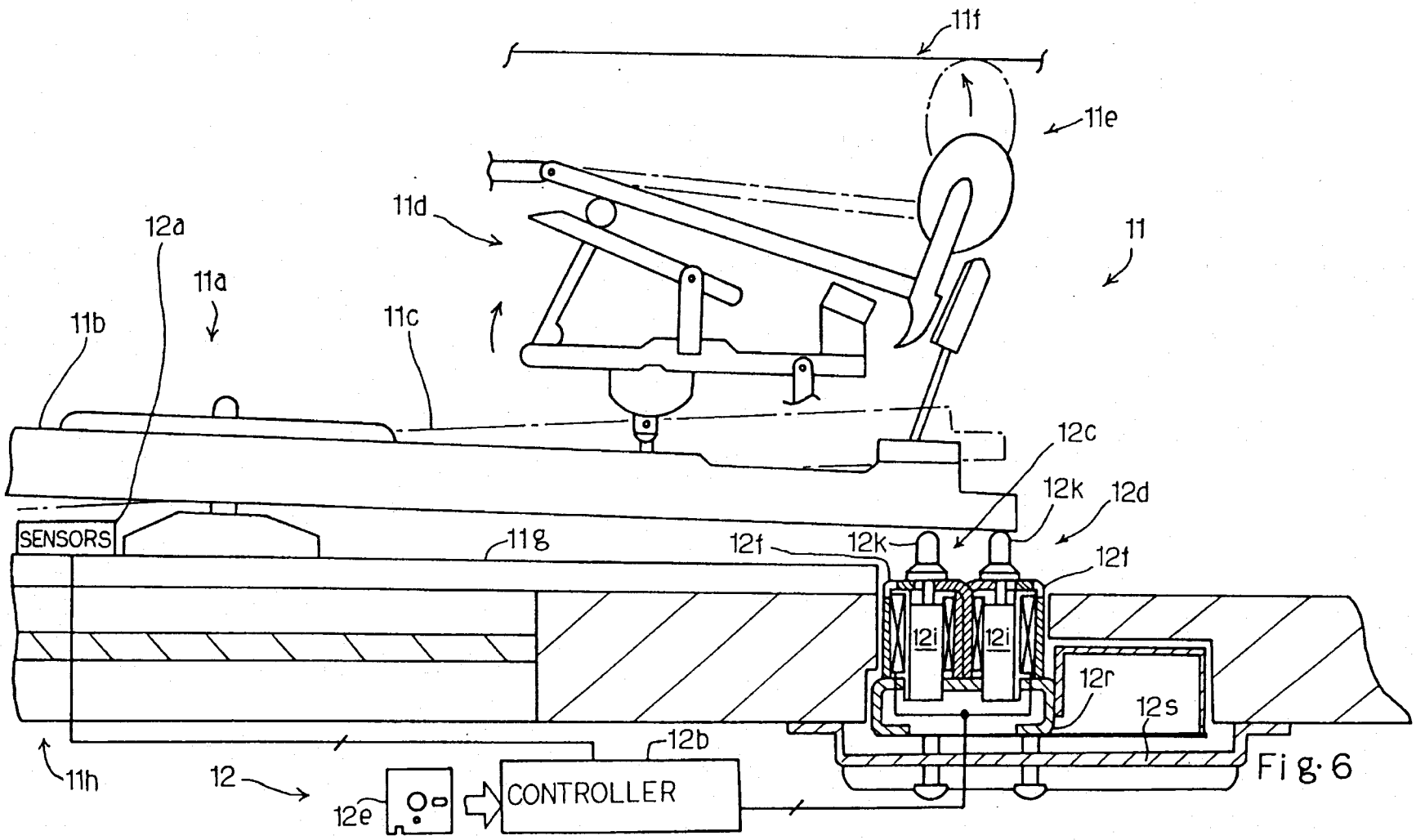
FIG. 6 is a cross sectional view showing an automatic player piano according to the present invention.

Referring to FIG. 6 of the drawings, an automatic player piano embodying the present invention largely comprises a grand piano 11 and a key driving system 12, and selectively enters into at least a playing mode and a playback mode.

The grand piano 11 is similar in structure to an ordinary grand piano, and comprises a keyboard 11*a* implemented by a plurality of black and white keys 11*b* and 11*c*, a plurality of key action mechanisms 11*d* respectively associated with the black and white keys 11*b* and 11*c*, a plurality of hammer assemblies 11*e* driven for rotation by the respective key action mechanisms 11*d* and a plurality sets of strings 11*f* struck by the associated hammer assemblies 11*e* for producing acoustic sounds. The keyboard 11*a* is placed on a key frame 11*g*, and the black and white keys 11*b* and 11*c* are swingable with respect to the key frame 11*g*. For this reason, the key frame 11*g* serves as a stationary board member in this instance. The key frame 11*g* is supported by a key bed structure 11*h*, and the key bed structure 11*h* is in turn supported by legs (not shown) as well known to a person skilled in the art.

The key driving system 12 comprises a plurality of sensors 12*a* respectively associated with the black and white keys 11*b* and 11*c* for monitoring the motions of the black and white keys 11*b* and 11*c*, a controller 12*b* communicable with the sensors 12*a* for storing pieces of music information for a music and a plurality of solenoid-operated actuator units 12*c* and 12*d* supported by the key bed structure 11*h*.

The controller 12*b* is enabled in the playback mode, and sequentially retrieves the pieces of music information for selectively energizing the solenoid-operated actuator units 12*c* and 12*d*. The pieces of music information are produced through a fingering on the keyboard 11*a* in the playing mode, and a floppy disk 12*e* may give the pieces of music information in the playback mode.

The solenoid-operated actuator units 12*c* are respectively associated with the odd keys, and the solenoid-operated actuator units 12*d* are respectively provided for the even keys as similar to the prior art automatic player piano. The solenoid-operated actuator units 12*c* and 12*d* are similar in structure to one another, and one of the solenoid-operated actuator units 12*c* and 12*d* is described in detail with reference to FIG. 7.

Each solenoid-operated actuator unit 12*c* or 12*d* comprises a part of a yoke member 12*f* of ferromagnetic substance, a coil bobbin 12g housed in the yoke member 12f, a coil member 12h wound on the coil bobbin 12g, a plunger member 12i slidably inserted in an inner space of the coil bobbin 12g and partially projecting from a hole 12j formed in the yoke member 12f and a head member 12k attached to the leading end portion of the plunger 12i, and the yoke member 12f is shared between the other solenoid-operated actuator unit 12c or 12d of the same row.

Figure 8:
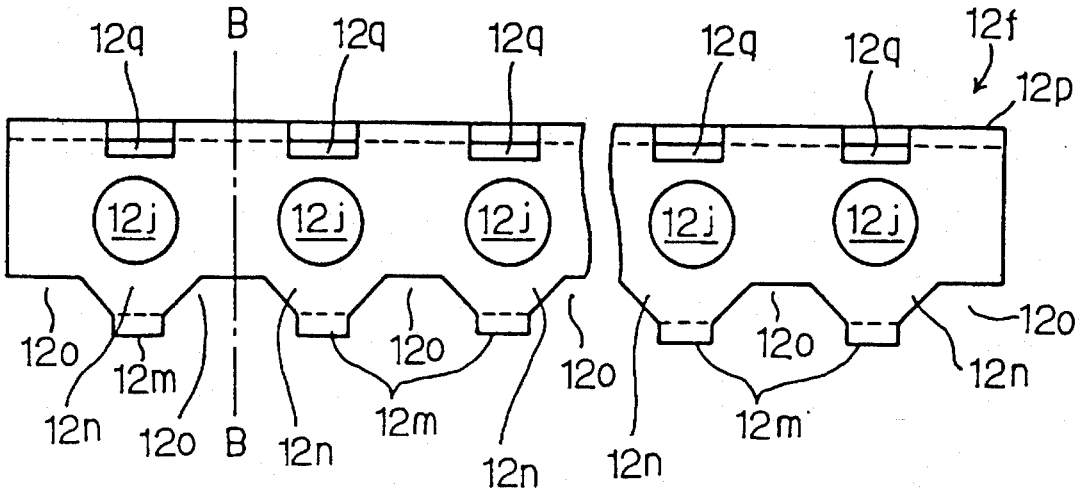
FIG. 8 is a plan view showing a yoke member incorporated in the solenoid-operated actuator unit shown in FIG. 7.
Figure 9:
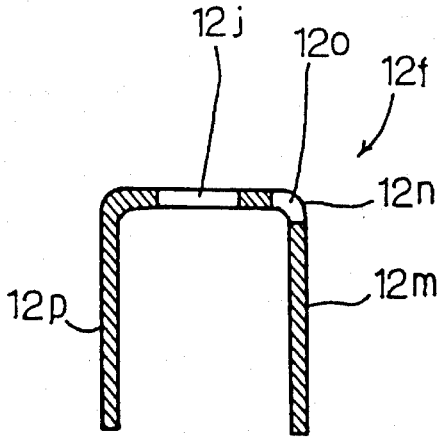
FIG. 9 is a cross sectional view taken along line B—B of FIG. 8.

As will be better seen from FIGS. 8 and 9, the yoke member 12f is a generally elongated channel shape, and the holes 12j are formed in the upper surface portion of the yoke member 12f at intervals. The corners of the yoke member 12f are rounded as similar to the prior art yoke member 2e, and are assumed to have the radius of curvature r1. The yoke member 12f of the solenoid-operated actuator units 12c has a side wall portion 12m to be interdigitated with a corresponding side wall portion of the yoke member 12f for the other solenoid-operated actuator units 12d. The rounded corner of the side wall portion 12m is partially removed between the holes 12j, and trapezoid-shaped projections 12n and trapezoid-shaped hollow spaces 12o are left in the side wall portion 12m and the upper wall portion. The yoke member 12f further has the other side wall portion 12p, and the rounded corner of the other side wall portion is also partially removed at the opposite positions to the trapezoid-shaped projections 12n. In other words, other hollow spaces 12q are formed beside the holes 12j, and each hollow space 12q and each trapezoid-shaped projection 12n are located on both sides of each hole 12j.

Figure 7:
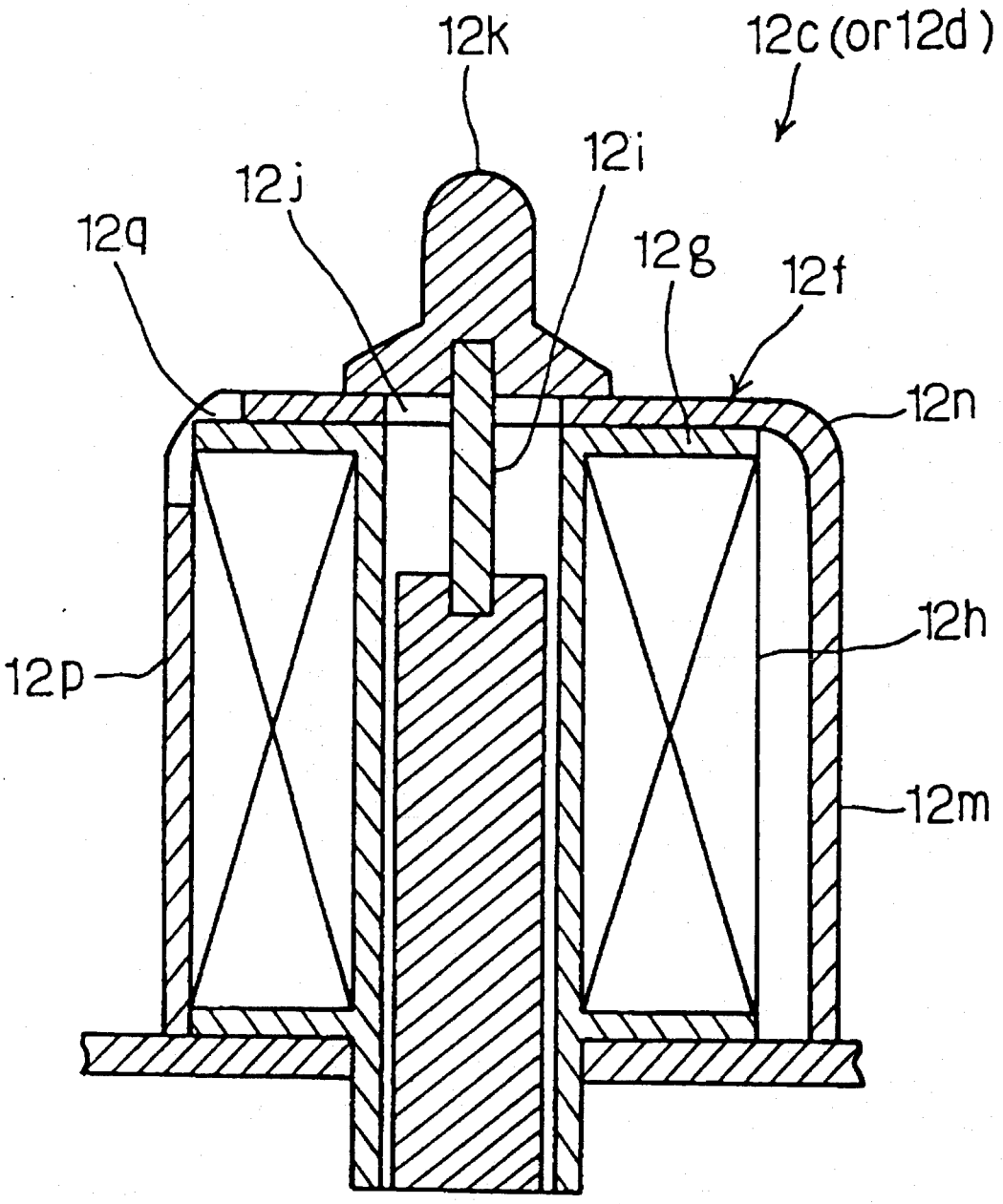
FIG. 7 is a cross sectional view showing the structure of a solenoid-operated actuator unit incorporated in the automatic player piano according to the present invention.

In the assembling work, the coil members 12h wound on the respective coil bobbins 12g are inserted in the yoke member 12f, and the coil members 12h are partially exposed to the hollow spaces 12q as shown in FIG. 7. This means that the turns of each coil member 12h are increasable until the outermost coil members reach the inner surface of the side wall portion 12p as shown in FIG. 7, and the prolonged coil member 12h increases the electro-magnetic force without enlargement of the yoke member 12f.

Figure 10:
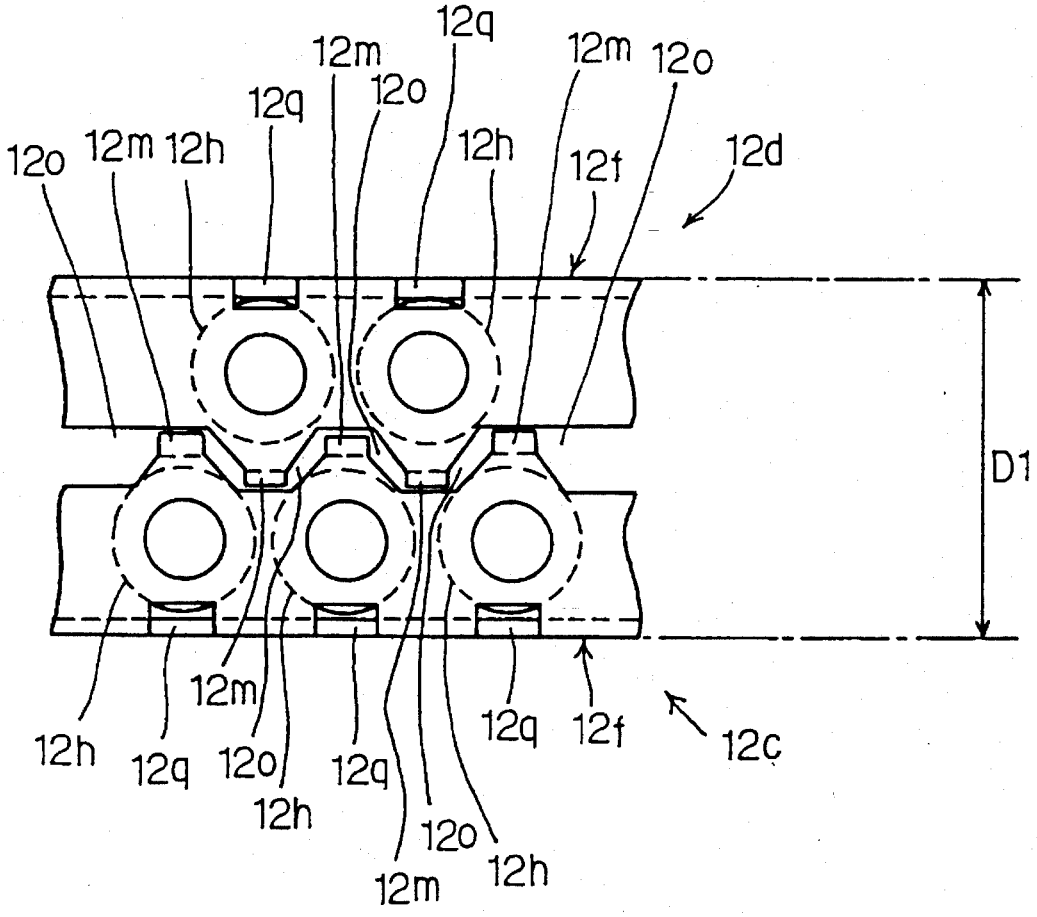
FIG. 10 is a plan view showing the arrangement of an array of solenoid-operated actuator units incorporated in the automatic player piano according to the present invention.

When the solenoid-operated actuator units 12c and 12d are assembled with the grand piano 11, the trapezoid-shaped projections 12m are firstly inserted into the trapezoid-shaped hollow spaces 12o as shown in FIG. 10, and the row of the solenoid-operated actuator units 12c is interdigitated with the other row of the solenoid-operated actuator units 12d. The width D1 of the two rows of solenoid-operated actuator units 12c and 12d is less than the double of the distance between the side wall portions 12m and 12p in so far as the number of turns per unit length is equal to that of the prior art solenoid-operated actuator units 2c and 2d. Thus, the solenoid-operated actuator units 12c and 12d are smaller in size than the prior art solenoid-operated actuator units 2c and 2d, and a manufacturer can remodel a small-sized grand piano to the automatic player piano.

Moreover, the interdigitated arrangement decreases the distance between the plungers 12i of one row and the plungers 12i of the other row, and the stroke of the plungers 12i takes up the difference in height from the key bed structure 11h between the odd keys and the even keys. If the distance between the two rows is decreased to 16 millimeters, the difference in height is only 0.5 millimeter, and the plungers 12i can take up the difference. For this reason, the manufacturer prepares only one kind of solenoid-operated actuator units for the automatic player piano.

On the other hand, if the manufacturer further needs large electro-magnetic force for driving each key, the manufacturer increases the number of turns per unit length without enlargement of a slot formed in the key bed structure 11h for embedding the two rows of solenoid-operated actuator units, and the large electro-magnetic forces promptly move the black and white keys 11b and 11c.

The two rows of solenoid-operated actuator units 12c and 12d thus interdigitated are finally embedded in the key bed structure 11h, and are supported by means of a base member 12r and a bracket member 12s as shown in FIG. 6.

The automatic player piano implementing the embodiment behaves as follows. If a player wants to perform a music in the playing mode, the player selectively depresses the black and white keys 11b and 11c, and the associated key action mechanisms 11d convert the upward motions of the depressed keys 11b and 11c into the rotations of the associated hammer assemblies 11e. The hammer assemblies 11e strike the associated sets of strings 11f, and rebound thereon. The sets of strings 11f vibrate for producing acoustic sounds. If the player instructs the controller 12b to record the performance, the controller 12b fetches the electric signals supplied from the sensors 12a, and memorizes pieces of music information therein.

The player is assumed to instruct the controller to reproduce the music. The controller sequentially retrieves the pieces of music information, and selectively energizes the solenoid-operated actuator units 12c and 12d. The solenoid-operated actuator units 12c and 12d energized by the controller project the plungers 12i, and the head members 12k push the rear end portions of the black and white keys 11b and 11c as if the player depresses the keys 11b and 11c. As a result, the associated key action mechanisms 11d cause the associated hammer assemblies 11e to strike the strings 11f, and the acoustic sounds are reproduced by the controller 12b.

As will be appreciated from the foregoing description, the solenoid-operated actuator units 12c and 12d interdigitated with one another are smaller in size than the prior art solenoid-operated actuator units 2c and 2d without sacrifice of the electro-magnetic forces, or the electro-magnetic forces are increased without sacrifice of actuator's dimensions, Moreover, the yoke members 12f partially exposing the coil members 12h allow the manufacturer to increase the turns, and the electro-magnetic forces are increased without enlargement of the yoke members.

Figure 11:
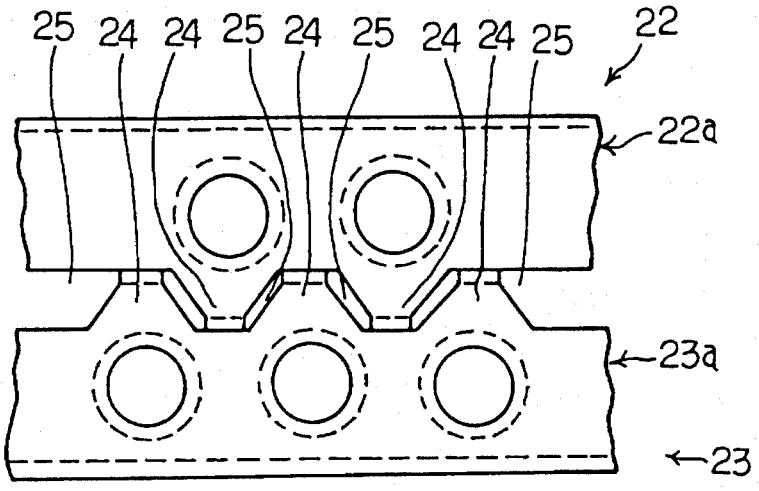
FIG. 11 is a plan view showing solenoid-operated actuator units incorporated in another automatic player piano according to the present invention.

The combination of the projections 12m and the hollow spaces 12o is independent from the hollow spaces 12q, and the combination and the hollow spaces 12q are selectively available for the yoke members. Two rows of solenoid-operated actuator units 22 and 23 may have respective yoke members 22a and 23a with combinations of trapezoid-shaped projections 24 and trapezoid-shaped hollow spaces 25 as shown in FIG. 11.

Figure 12D:
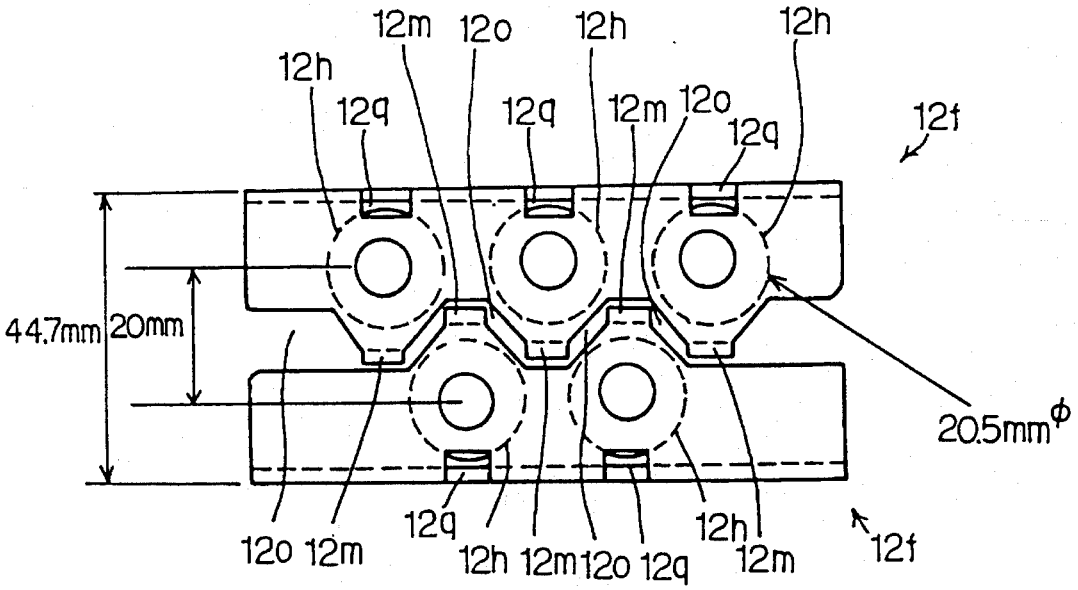
FIGS. 12B to 12E are plan views showing the dimensions of various solenoid-operated actuator units embodying the present invention.
Figure 12A:
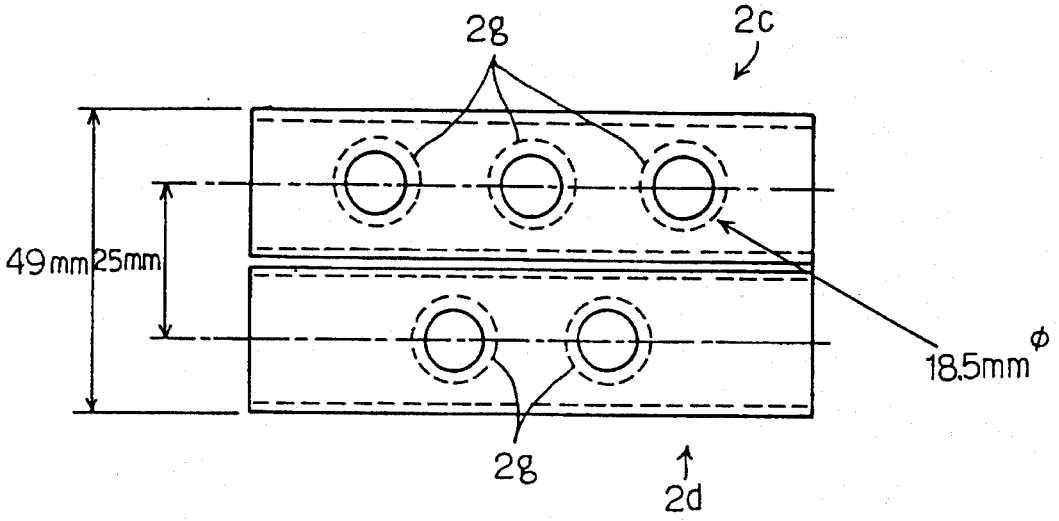
Fig. 12A PRIOR ART
FIG. 12A is a plan view showing the dimensions of the prior art solenoid-operated actuator units.

FIG. 12A illustrates the dimensions of the prior art solenoid-operated actuator units 2c and 2d, and FIGS. 12B to 12E illustrate the dimensions of various solenoid-operated actuator units according to the present invention. The prior art solenoid-operated actuator units 2c and 2d are equipped with the coil members 2g of 18.5 millimeters in diameter, and are 49 millimeters in total width. The distance between the two rows is 25 millimeters due to the dead spaces on both sides of the coil members 2g.

Figure 12B:
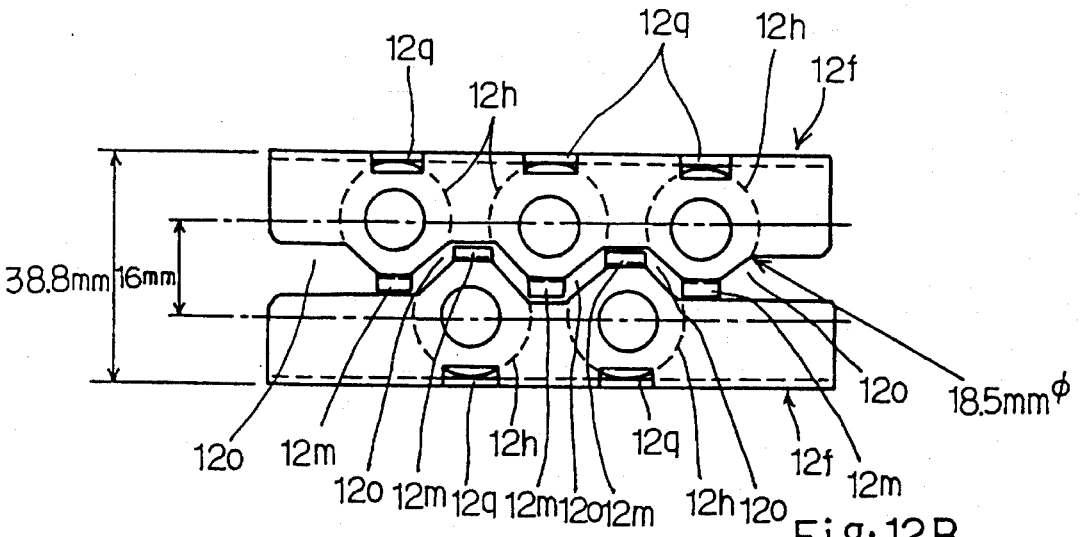

If both of the combination and the hollow spaces are formed in the yoke members 12f, the total width is decreased to 38.8 millimeters without decrease of coil member's diameter, and the distance between the two rows is decreased to 16 millimeters (see FIG. 12B). The large coil members 12*h* decrease the amount of current without sacrifice of the electro-magnetic force.

Figure 12C:
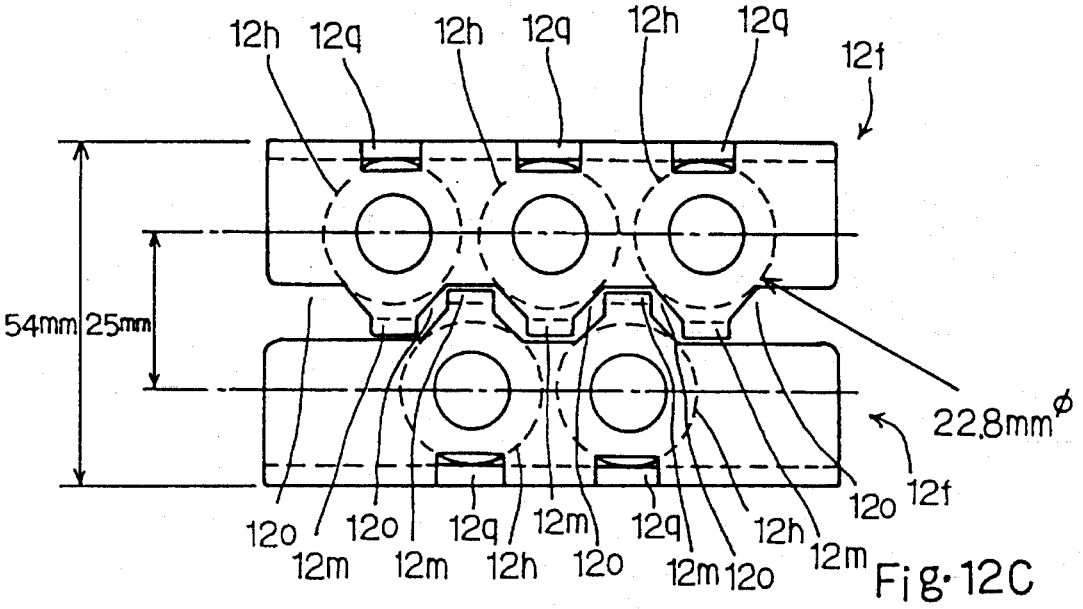

If the manufacturer needs to maintain the distance between the two rows, the coil members 12*h* are increased in diameter to 22.8 millimeters when the total width is increased to 54 millimeters as shown in FIG. 12C.

Another example is 44.7 millimeters in total width and 20 millimeters in distance between the two rows, and the coil members 12*h* are 20.5 millimeters in diameter (see FIG. 12D).

Figure 12E:
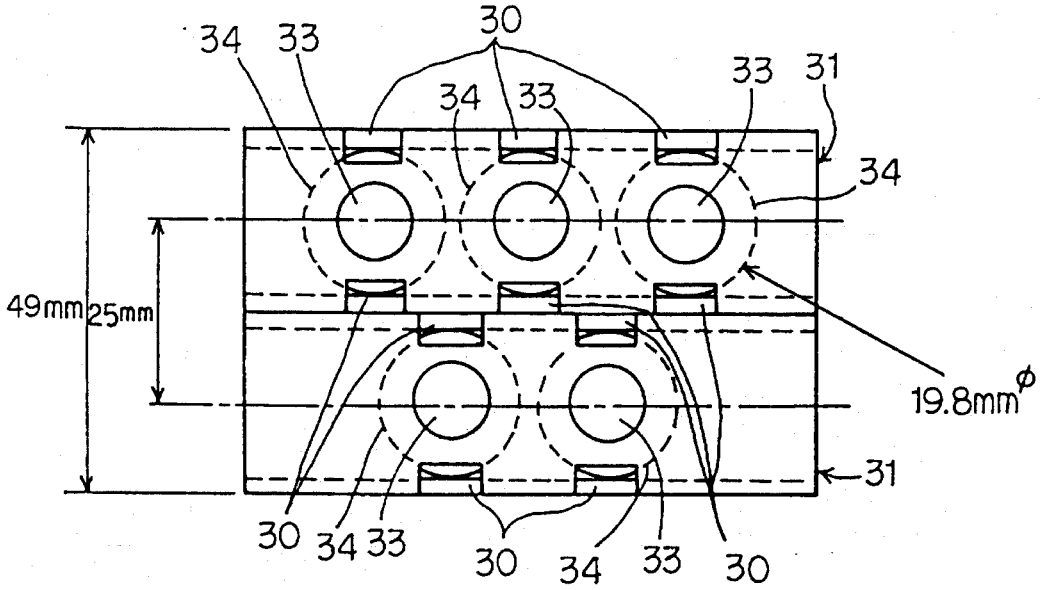

If only hollow spaces 30 are formed in yoke members 31 on both sides of holes 33, the total width and the distance between the two rows are 49 millimeters and 25 millimeters, and coil members 34 are 19.8 millimeters in diameter as shown in FIG. 12E. Although the total width is equal to that of the prior art, the coil members 34 are increased in diameter, and the current consumption is decreased.

Although particular embodiments of the present invention have been shown and described, it will be obvious to those skilled in the art that various changes and modifications may be made without departing from the spirit and scope of the present invention. For example, the array of solenoid-operated actuator units may be incorporated in any kind of keyboard musical instrument for selectively driving the keys, and the solenoid-operated actuator units may be arranged in more than two rows. Moreover, the projections and the hollow spaces interdigitated with one another are not limited to the trapezoid, and may be shaped into various configurations. The hollow spaces 30 may be formed in one of the two rounded corner portions of the yoke member 31.

What is claimed is:

1. A keyboard musical instrument selectively entering into at least a playing mode for producing acoustic sounds through a fingering and a playback mode for producing acoustic sounds without the fingering, comprising:

a) an acoustic piano having a-1) a keyboard having a plurality of keys swingable with respect to a stationary board member forming a part of said acoustic piano, and allowing a player to perform a music through said fingering in said playing mode, a-2) a plurality of sets of strings associated with said plurality of keys for producing said acoustic sounds, respectively, a-3) a plurality of hammer assemblies respectively associated with said plurality of sets of strings and rotatable toward the associated sets of strings, and a-4) a plurality of key action mechanisms respectively associated with said plurality of keys and linked between the associated keys and the associated hammer assemblies for driving said associated hammer assemblies toward said associated sets of strings when the associated keys are depressed; and b) a key driving system enabled in said playback mode, and having b-1) a plurality of sets of coil members and plungers arranged in rows, respectively associated with said plurality of keys, and selectively actuating the associated keys as if said player depresses through said fingering, and b-2) a plurality of yoke members, wherein each yoke member houses at least two of said sets of coil members and plungers in one of said rows, one of said yoke members having first projections and first hollow spaces alternately arranged on one side thereof, another of said plurality of yoke members having second projections and second hollow spaces alternately arranged on one side thereof, said first projections and said second projections being inserted into said second hollow spaces and said first hollow spaces, respectively, so that said one of said plurality of yoke members is interdigitated with said another of said plurality of yoke members.

2. A keyboard musical instrument selectively entering into at least a playing mode for producing acoustic sounds through a fingering and a playback mode for producing acoustic sounds without the fingering, comprising:

a) an acoustic piano having a-1) a keyboard having a plurality of keys swingable with respect to a stationary board member forming a part of said acoustic piano, and allowing a player to perform a music through said fingering in said playing mode, a-2) a plurality of sets of strings associated with said plurality of keys for producing said acoustic sounds, respectively, a-3) a plurality of hammer assemblies respectively associated with said plurality of sets of strings and rotatable toward the associated sets of strings, and a-4) a plurality of key action mechanisms respectively associated with said plurality of keys and linked between the associated keys and the associated hammer assemblies for driving said associated hammer assemblies toward said associated sets of strings when the associated keys are depressed; and b) a key driving system enabled in said playback mode, and having b-1 a plurality of sets of coil members and plungers respectively associated with said plurality of keys and selectively actuating the associated keys as if said player depresses through said fingering, and b-2) a plurality of yoke members supporting said plurality of sets of coil members and plungers and interdigitated with one another, one of said yoke members having first projections and first hollow spaces alternately arranged on one side thereof, another of said plurality of yoke members having second projections and second hollow spaces alternately arranged on one side thereof, said first projections and said second projections being inserted into said second hollow spaces and said first hollow spaces, respectively, so that said one of said plurality of yoke members is interdigitated with said another of said plurality of yoke members, said one of said plurality of yoke members having a rounded corner portion on the opposite side thereof, third hollow spaces being formed in the rounded corner portion at intervals so that outer surfaces of said coil members are arranged to be as close to an inner surface of said one of said plurality of yoke members as possible.

3. A keyboard musical instrument selectively entering into at least a playing mode for producing acoustic sounds through a fingering and a playback mode for producing acoustic sounds without the fingering, comprising:

a) an acoustic piano having a-1) a keyboard having a plurality of keys swingable with respect to a stationary board member forming a part of said acoustic piano, and allowing a player to perform a music through said fingering in said playing mode, a-2) a plurality sets of strings associated with said plurality of keys for producing said acoustic sounds, respectively, a-3) a plurality of hammer assemblies respectively associated with said plurality sets of strings and rotatable toward the associated sets of strings, and a-4) a plurality of key action mechanisms respectively associated with said plurality of keys and linked between the associated keys and the associated hammer assemblies for driving said associated hammer assemblies toward said associated sets of strings when the associated keys are depressed; and b) a key driving system enabled in said playback mode, and having b-1) a plurality sets of coil members and plungers respectively associated with said plurality of keys and selectively actuating the associated keys as if said player depresses through said fingering, and b-2) a plurality of yoke members supporting said plurality sets of coil members, each of said plurality of yoke members having rounded corner portions between side wall portions thereof and an upper wall portion thereof, a plurality of first hollow spaces being formed in one of said rounded corner portions at intervals for partially exposing the associated set of coil members and plungers, thereby arranging outer surfaces of the associated coil members to be as close to an inner surface of said each of said plurality of yoke members as possible.

4. The keyboard musical instrument as set forth in claim 3, in which a plurality of second hollow spaces are formed in the other of said rounded corner portions at intervals for partially exposing the associated set of coil members and plungers, thereby snugly receiving said associated set of coil members and plungers in an inner space of said each of said plurality of yoke members.

5. The keyboard musical instrument as set forth in claim 3, in which projections and third hollow spaces are alternately formed in the other of said rounded corner portions, whereby the projections and the third hollow spaces of one of said plurality of yoke members are interdigitated with the third hollow spaces and the projections of another of said plurality of yoke members.

6. A musical instrument comprising:

a piano having a plurality of keys; and a key driving system comprising:

plungers arranged in rows and selectively actuating associated ones of said keys, and yoke members, wherein each yoke member houses at least two of said plungers in one of said rows, one of said yoke members having first projections and first hollow spaces alternately arranged on one side thereof, another of said yoke members having second projections and second hollow spaces alternately arranged on one side thereof, said first projections and said second projections being insertable into said second hollow spaces and said first hollow spaces, respectively, so that said one of said yoke members is interdigitated with said another of said yoke members.

7. A musical instrument comprising:

a piano having a plurality of keys; and a key driving system comprising:

a plurality of sets of coil members and plungers associated with said plurality of keys and selectively actuating the associated keys, and a plurality of yoke members arranged in rows so as to be shared among said plurality of coil members and plungers, wherein each of said plurality of yoke members has rounded corner portions between a wall portion and an upper wall portion thereof, a plurality of hollow spaces being formed in one of said rounded corner portions at intervals for partially exposing associated coil members.

* * * * *